US005357637A

United States Patent [19]

Moore

[11] Patent Number: 5,357,637

[45] Date of Patent: Oct. 25, 1994

[54] EXERCISE PANTS AND EXERCISE BAND ASSEMBLY

[76] Inventor: Derrick F. Moore, 1909 Winona Dr., Plano, Tex. 75074

[21] Appl. No.: 160,971

[22] Filed: Dec. 3, 1993

[51] Int. Cl.[5] ..... A41D 1/06

[52] U.S. Cl. ..... 2/227; 2/69; 2/228; 482/121; 482/124

[58] Field of Search ..... 2/69, 70, 79, 228, 227, 2/80, 238, 338, 311; 482/105, 121, 124, 131, 74; 602/90.1, 60, 61, 62, 64, 65, 75, 78

[56] References Cited

U.S. PATENT DOCUMENTS

| | | | |
|---|---|---|---|
| 2,097,376 | 10/1937 | Marshman | 482/124 |
| 4,065,814 | 1/1978 | Fox | 482/124 |
| 4,085,746 | 4/1978 | Castiglia | 602/65 |
| 4,815,731 | 3/1989 | Suarez et al. | 482/105 |
| 4,910,802 | 3/1990 | Malloy | 2/69 |
| 4,953,856 | 9/1990 | Fox, III | 2/69 |
| 5,046,194 | 9/1991 | Alainz et al. | 2/69 |
| 5,109,546 | 5/1992 | Dicker | 2/227 |
| 5,186,701 | 2/1993 | Wilkinson | 482/124 |
| 5,201,074 | 4/1993 | Dicker | 2/227 |
| 5,267,928 | 12/1993 | Barile et al. | 482/124 |

OTHER PUBLICATIONS

Gershman, M.D; Maurice; Self-Adhering Nylon Tapes, Journal of the American Medical Assoc., vol./68, No. 7, p. 930.

*Primary Examiner*—Clifford D. Crowder
*Assistant Examiner*—Gloria Hale
*Attorney, Agent, or Firm*—John E. Vandigriff

[57] ABSTRACT

The invention is to a elastic band attachable above the knees of the wearer to the sides of pants being worn. The elastic band has attachment devices secured to the elastic band which are fastened to attachment devices on the pants. As the wearer walks or cycles, the elastic band helps tone the leg muscles and provide a form of aerobic exercise.

19 Claims, 2 Drawing Sheets

EXERCISE PANTS AND EXERCISE BAND ASSEMBLY

FIELD OF THE INVENTION

This invention relates to exercise garments, and more particularly to a pants, shorts, skirts, or dress, and elastic belt combination to be worn during jogging, walking, training, or cycling to exercise the legs and thighs.

BACKGROUND OF THE INVENTION

Various special exercise garments have been made to provide isometric exercising for the legs and arms. These garments are generally specialty garments that are worn for the purpose of stationary isometric exercise only and generally have belts or straps that are sewn into the garments and cannot be removed. For example, U.S. Pat. No. 5,201,074, includes bands that encircle the legs from the hips to the ankle, or in the case of short pants, from the waist to the end of the pants. Other bands may be around the waist or in the top piece of the garment.

Other apparatus, U.S. Pat. No. 5,186,701 and 2,097,376, use bands that encircle the waist, ankles and wrists with elastic straps between the bands. The devices are cumbersome and are not suitable for, for example jogging and cycling.

Individual stretch bands that are not attached to clothing are described in U.S. Pat. Nos. 3,819,177 and 4,815,731. These devices are used primarily for exercising the arms and/or legs from a standing or reclining position.

SUMMARY OF THE INVENTION

The invention is to an elastic exercise belt that is used in combination with an article of clothing, such as shorts, workout pants and even dresses. Attachment devices such as VELCRO, hook and loop (a trademarked product of American Thread Company) fasteners, hooks, straps, and snaps are attached to the side of the garment on the outside of the thigh region above the knees. The elastic band is wrapped around the outside of the legs and secured to the attachment device. During jogging and cycling, as one leg moves ahead of the other, the other leg will resist being pulled forward and provide an aerobic action between the two legs. Elastic bands of various elasticity may be progressively used to strengthen the legs, stamina and speed, and generally provide varying degrees of aerobic exertion.

The bands are light weight and are not bulky and may be easily carried in a pocket or purse before and after used. Since the elastic bands do not completely encircle an individual leg, blood circulation is not impeded. After use, the elastic bands may be removed, and a change of clothing is not necessarily needed, as in weight pants.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
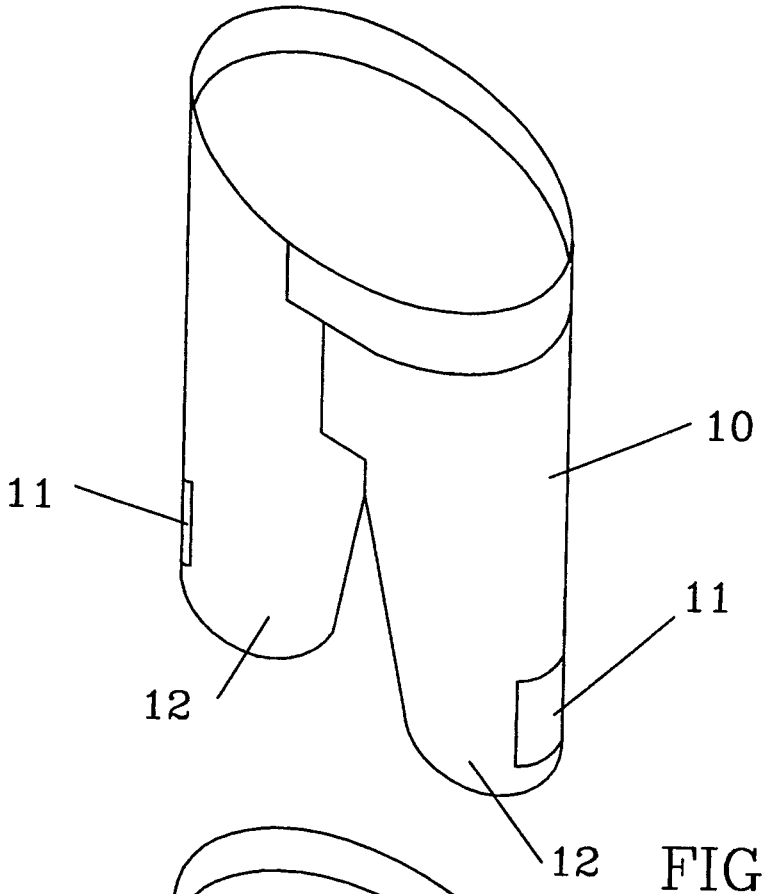
FIG. 1 shows a garment with elastic band attachment devices.

FIG. 1 illustrates a pair of short pants 10, which may be regular pants, exercise pants or stretch pants used by cyclist. Attached to each leg 12 is an attachment device 11 which may be of VELCRO, snaps hooks, or straps. Attachment device 11 is attached to pant legs 12 along the outside of the leg area just above the knees of the wearer. Attachment device 11 may also be attached to a dress along the outside of the dress adjacent the upper leg, or within the hem, just above the knees.

Figure 2:
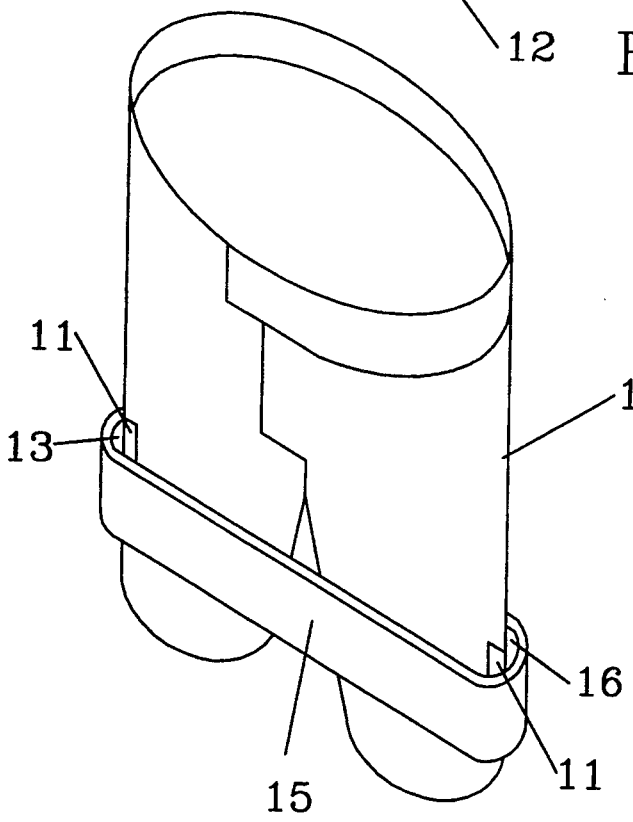
FIG. 2 shows a garment with an elastic exercise band attached.

FIG. 2 shows pants 10 with elastic exercise belt 15 wrapped around the both legs 12, and attached to the attachment device 11. Elastic band 15 wraps completely around the legs of the wearer and attaches to itself, and to the attachment device 11 at the sides of the pants. Since elastic band 15 attaches to its self, and is only held up above the knees by the attachment devices 11 on the pants and a mating attachment device (illustrated in FIG. 3) on the elastic band, there is no pressure applied around the legs which could impede blood circulation in the legs.

Elastic bands of various elasticity can be used. A elastic band of greater elasticity (easily stretched) can be used at first. As leg strength is build up, elastic bands of lesser elasticity (harder to stretch) can be used.

Figure 3:
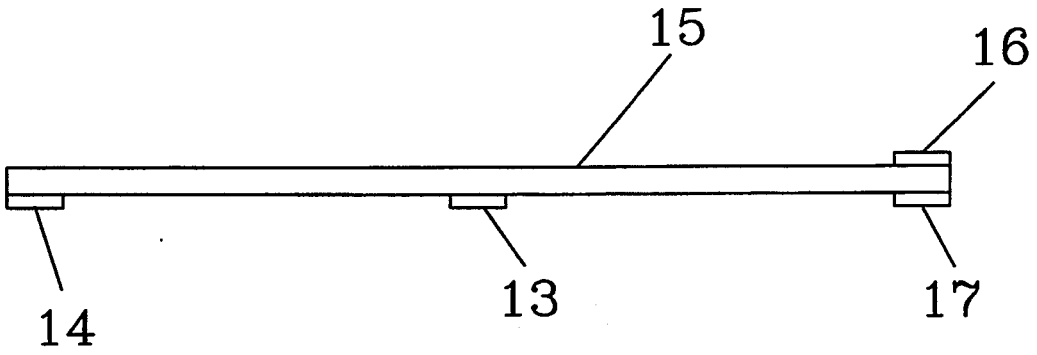
FIG. 3 shows an unattached exercise band.

FIG. 3 shows a top view of elastic band 15. An attachment device 13 is in or near the center of the band. Attachment device 13 is attached to one of the attachment devices 11 on the pants. One end of elastic band 15 has an attachment device 14 on one side of elastic band 15 and another attachment device 17 on the other end of elastic band 15. On the other side of elastic band 15, opposite attachment device 17, is attachment device 14.

Figure 4:
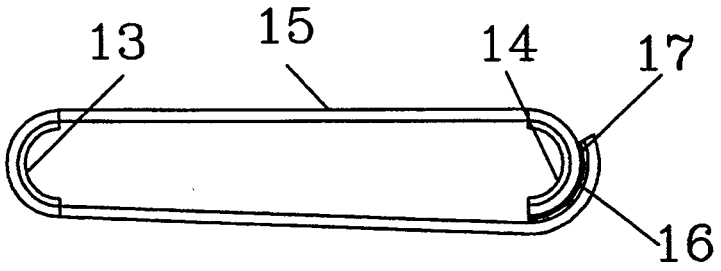
FIG. 4 shows a view of the exercise band wrapped around the legs of a garment.

FIG. 4 illustrates the wrapping of elastic band 15 around the legs, attaching to attachment devices 11 on the pants, and attaching to itself. As illustrated in FIG. 4, attachment device 17 is attached to an attachment device 11 on the side of the pants, and then elastic band 15 is wrapped around, for example the front of the legs so that attachment device 13 is attached to the attachment device 11 on the other pant leg. Elastic band 15 is then wrapped around the back of the legs and attachment device 14 is attached to attachment device 16. Elastic band 15 is now securely attached to the pants and to itself. The multiple attachments hold elastic band 15 around the legs above knees, attached to the pant to prevent it from falling and attached to the pants and itself to provide sufficient hold strength to prevent the band 15 from coming loose during use.

In another embodiment of the invention, the elastic band may be manufacture into the hem of the garment, or form an integral part of the garment.

What is claimed is:

1. An elastic exercise band for use with and in combination with an article of clothing, comprising:

an elongated elastic band having first and second ends, and of a length to extend around a wearer's legs above the knees;

attachment means on said article of clothing;

at least two attachment mean on said elastic band for attaching the elastic band to the attachment means on the article of clothing above the knees; and a pair of attachments devices on said elastic band to attach said first end to said second end.

2. The elastic exercise band according to claim 1, wherein said attachment devices are made from hook and loop type fasteners.

3. The elastic exercise band according to claim 1, wherein said attachment devices are snaps.

4. The elastic exercise band according to claim 1, wherein said attachment devices are made from straps with buckles.

5. The elastic exercise band according to claim 1, wherein said attachment devices are made from hooks.

6. The elastic exercise band according to claim 1, wherein said at least two attachment devices are on opposite ends of the elastic band, and another attachment device is located in the center of said elastic band.

7. The elastic exercise band according to claim 1, wherein said at least two attachment devices and one of said pair of attachment devices is on one side of said elastic band, and the other of said pair of elastic attachment device is on a side of said elastic band opposite from the side said at least two and said one of said pair are attached.

8. An elastic exercise band for use with and in combination with an article of clothing, comprising:

an elongated elastic band having first and second ends, and of a length to extend around a wearer's legs above the knees;

at least two attachment means on said article of clothing;

at least two attachment devices on one side of said elastic band for attaching the elastic band to the attachment means on the article of clothing above the knees;

a pair of attachment devices on said elastic band to attach said first end to said second end; and a pair of attachment devices on alternate sides of said elastic band to attach said first end to said second end.

9. The elastic exercise band according to claim 8, wherein said attachment devices are made from hook and loop type fasteners.

10. The elastic exercise band according to claim 8, wherein said attachment devices are snaps.

11. The elastic exercise band according to claim 8, wherein said attachment devices are made from straps with buckles.

12. The elastic exercise band according to claim 8, wherein said attachment devices are made from hooks.

13. An elastic exercise band for use with and in combination with an article of clothing, comprising:

a pair of pants suitable for wearing while jogging and cycling;

an attachment device on each of the outside of the pants legs secured to the pants leg at a point above the knees of the wearer;

an elongated elastic band having first and second ends, and of a length to extend around a wearer's legs above the knees;

at least two attachment devices on said elastic band for attaching the elastic band to the attachment devices on the pants legs; and a pair of attachment devices on said elastic band to attach said first end of said elastic band to said second end of said elastic band.

14. The combination according to claim 13 wherein said elastic band is an integral part of the garment.

15. The elastic exercise band according to claim 13, wherein said attachment devices are made from hook and loop type fasteners.

16. The elastic exercise band according to claim 13, wherein said attachment devices are snaps.

17. The elastic exercise band according to claim 13, wherein said attachment devices are made from straps with buckles.

18. The elastic exercise band according to claim 13, wherein said at least two attachment devices are on opposite ends of the elastic band, and another attachment device is located in the center of said elastic band.

19. The elastic exercise band according to claim 13, wherein said at least two attachment devices and one of said pair of attachment devices is on one side of said elastic band, and the other of said pair of elastic attachment devices is on a side of said elastic band opposite from the side said at least two and said one of said pair are attached.

* * * * *